US007907039B2

(12) United States Patent
Yargole et al.

(10) Patent No.: US 7,907,039 B2
(45) Date of Patent: Mar. 15, 2011

(54) COMPACT DRY TRANSFORMER

(75) Inventors: Arun Dattatraya Yargole, Mumbai (IN); Baburao Keshwatkar, Mumbai (IN); Ramdas Shridhar Kirjat, Aurangabad (IN)

(73) Assignee: Crompton Greaves Limited, Mumbai, IN (US)

( * ) Notice: Subject to any disclaimer, the term of this patent is extended or adjusted under 35 U.S.C. 154(b) by 76 days.

(21) Appl. No.: 12/520,509

(22) PCT Filed: Feb. 22, 2008

(86) PCT No.: PCT/IN2008/000104

§ 371 (c)(1),
(2), (4) Date: Jun. 19, 2009

(87) PCT Pub. No.: WO2009/104197

PCT Pub. Date: Aug. 27, 2009

(65) Prior Publication Data

US 2010/0328002 A1 Dec. 30, 2010

(51) Int. Cl.
*H01F 27/08* (2006.01)
*H01F 27/06* (2006.01)
*H01F 27/02* (2006.01)

(52) U.S. Cl. ..... 336/61; 336/55; 336/59

(58) Field of Classification Search ..... 336/59, 336/55, 61, 65

See application file for complete search history.

(56) References Cited

U.S. PATENT DOCUMENTS 3,243,744 A 3/1966 Halacsy
3,551,863 A * 12/1970 Marton ..... 336/58
5,954,988 A * 9/1999 Lee ..... 219/757
6,563,410 B1 * 5/2003 Marton ..... 336/55
6,750,749 B2 * 6/2004 Shirahata et al. ..... 336/55
6,885,268 B2 * 4/2005 Choi ..... 336/57
7,227,754 B2 * 6/2007 Griesinger et al. ..... 361/714
7,369,024 B2 * 5/2008 Yargole et al. ..... 336/61

FOREIGN PATENT DOCUMENTS

JP 56162810 12/1981
JP 2000223323 8/2000

OTHER PUBLICATIONS

International Search Report dated Dec. 11, 2008 for related International Application No. PCT/IN2008/000104.

Written Opinion dated Dec. 11, 2008 for related International Application No. PCT/IN2008/000104.

* cited by examiner

*Primary Examiner* — Anh T Mai

(74) *Attorney, Agent, or Firm* — Klein, O'Neill & Singh, LLP

(57) ABSTRACT

An compact dry transformer (1A) comprising a magnetic material core (2) and a coil assembly (3) assembled onto the core. The core comprises heat dissipating covers (4) with cooling fins (5) snug fitted over the core. The coil assembly is mounted on the core over a heat dissipating shifted inner jacket (9) made of non-magnetic material in close contact with the inner jacket. At least one first heat pipe (11) provided with cooling fins is located between the core and inner jacket in close contact therewith. The coil assembly further comprises a heat dissipating shifted outer jacket (13) made of non-magnetic material snug fitted over the high voltage winding. At least one second heat pipe (15) protruding out of bushings provided with cooling fins is located against the outer jacket in close contact therewith.

1 Claim, 8 Drawing Sheets

COMPACT DRY TRANSFORMER

CROSS-REFERENCE TO RELATED APPLICATION

This application is a national phase filing, under 35 U.S.C. §371(c), of International Application No. PCT/IN2008/000104, filed Feb. 22, 2008, the disclosure of which is incorporated herein by reference in its entirety.

FIELD OF INVENTION

This invention relates to an improved compact dry transformer.

BACKGROUND OF INVENTION

Dry electrical transformers are advantageous over oil filled electrical transformers in several respects. Dry transformers do not require periodic maintenance and oil replacement as in the case of oil filled transformers. Oil is environmentally polluting and capable of causing health hazards besides being susceptible to fire accidents. Dry transformers are preferred for outdoor applications because of their properties like resistance to ultra-violet rays and moisture, flame proof nature or excellent insulation characteristics. Dry transformers generally operate at higher temperatures of the order of 120 to 180° C. and are preferred in hazardous areas such as mines, densely populated residential areas or hospitals. Dry transformers are also without the protective metallic tank required by the oil filled transformers.

We have described in our PCT Publication No WO 2006/016377 (based on Indian Patent Application No 307/MUM/2003 filed on 26 Mar. 2003) a compact dry transformer comprising a resin impregnated or encapsulated coil assembly. In order to increase heat dissipation and cooling efficiency of the transformer, heat sinks are provided on the core, between the core and low voltage winding (primary winding), between the low voltage winding and high voltage winding (secondary winding) and over the coil assembly. Further experiments and findings have shown that the resin impregnation or encapsulation of the windings offers resistance to the flow of heat from the windings to the heat sinks adjacent to and within the windings thereby reducing the cooling efficiency of the transformer. Heat retention in the windings over a period of time may damage the windings and reduce the life of the transformer. Also provision of heat sink within the coil assembly between the low voltage winding and high voltage winding increases the size of the high voltage winding correspondingly increasing the material cost and weight thereof. In order to ensure adequate resin impregnation between the layers of conductors of the windings, sufficient clearances are to be provided between the layers of conductors of the windings. As a result also, the size and weight of the transformer are increased.

OBJECTS OF INVENTION

An object of the invention is to provide an improved compact dry transformer which has increased cooling efficiency and increased life.

Another object of the invention is to provide an improved compact dry transformer which has reduced size and weight and is cost effective.

Another object of the invention is to provide an improved compact dry transformer which has reduced magnetic losses.

DESCRIPTION OF THE DRAWINGS

The following is a detailed description of the invention with reference to the drawings accompanying the provisional specification, in which.

DETAILED DESCRIPTION OF THE INVENTION

According to the invention there is provided an improved compact dry transformer comprising a magnetic material core and a coil assembly assembled onto the core, the core comprising heat dissipating covers with cooling fins snug fitted over the core, the covers being made of non-magnetic material having good thermal conductivity, the coil assembly comprising a low voltage winding and a high voltage winding with electric insulation layers between the layers of conductors of each of the windings and between the windings, the coil assembly being mounted on the core over a heat dissipating inner jacket made of non-magnetic material having good thermal conductivity in close contact with the inner jacket, the inner jacket having a slit along the length thereof, at least one first heat pipe located between the core and inner jacket in close contact therewith, the first heat pipe protruding out of the coil assembly and being provided with cooling fins at the protruding thereof, the coil assembly further comprising a heat dissipating outer jacket made of non-magnetic material having good thermal conductivity snug fitted over the high voltage winding, the outer jacket being provided with a slit along the length thereof, at least one second heat pipe located against the outer jacket in close contact therewith, the coil assembly with the outer jacket and second heat pipe being encapsulated with a resin casting with the second heat pipe protruding out of bushings cast with the resin casting, the protruding outer end of the second heat pipe being isolated from the ground potential by the bushings and provided with cooling fins, the terminals of the transformer being located in the bushings and connected to the windings ends.

Figure 1:
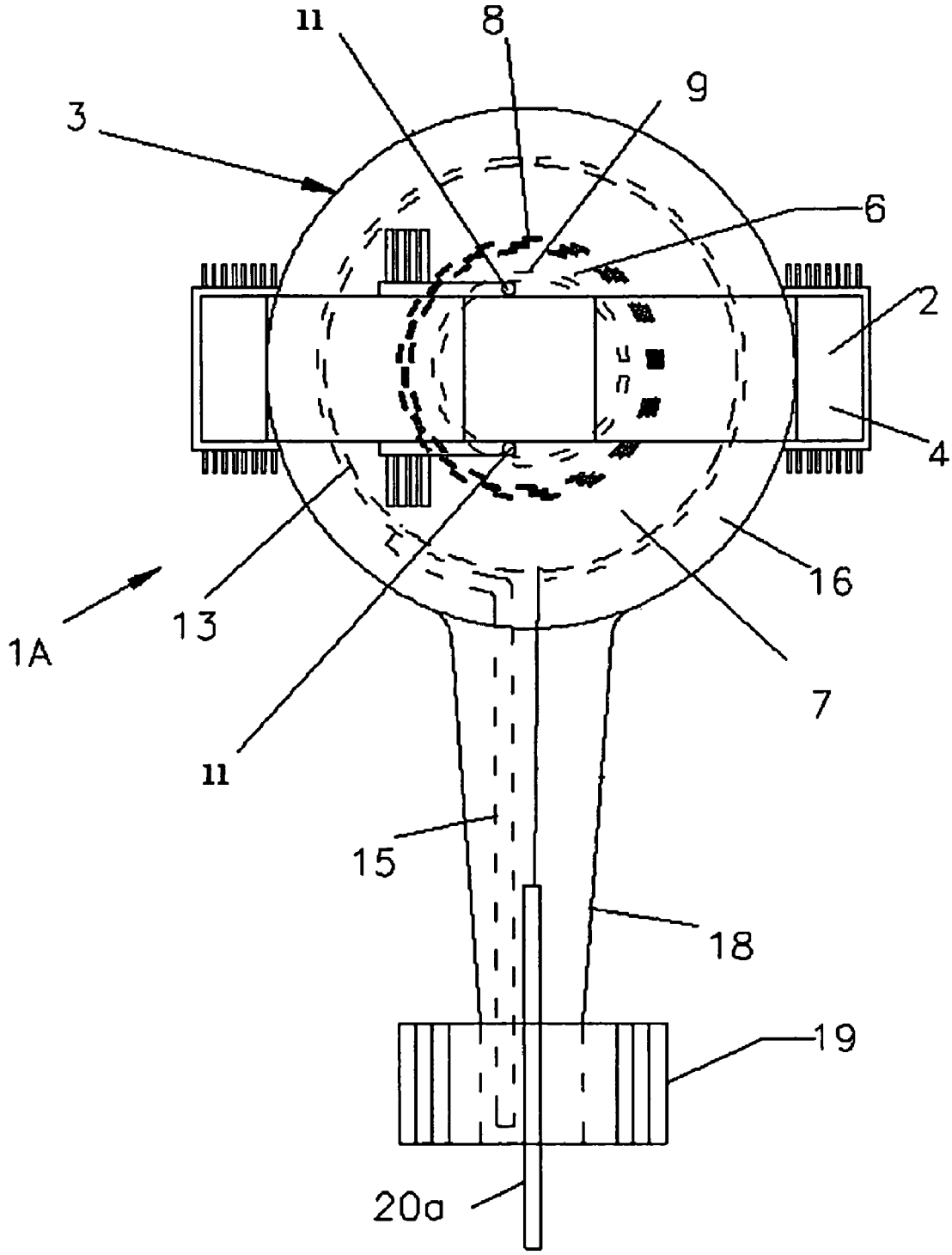
FIGS. 1, 2, 3 and 4 are plan, elevation, vertical cross-section and horizontal cross-section respectively of a single phase improved compact dry transformer according to an embodiment of the invention.
Figure 2:
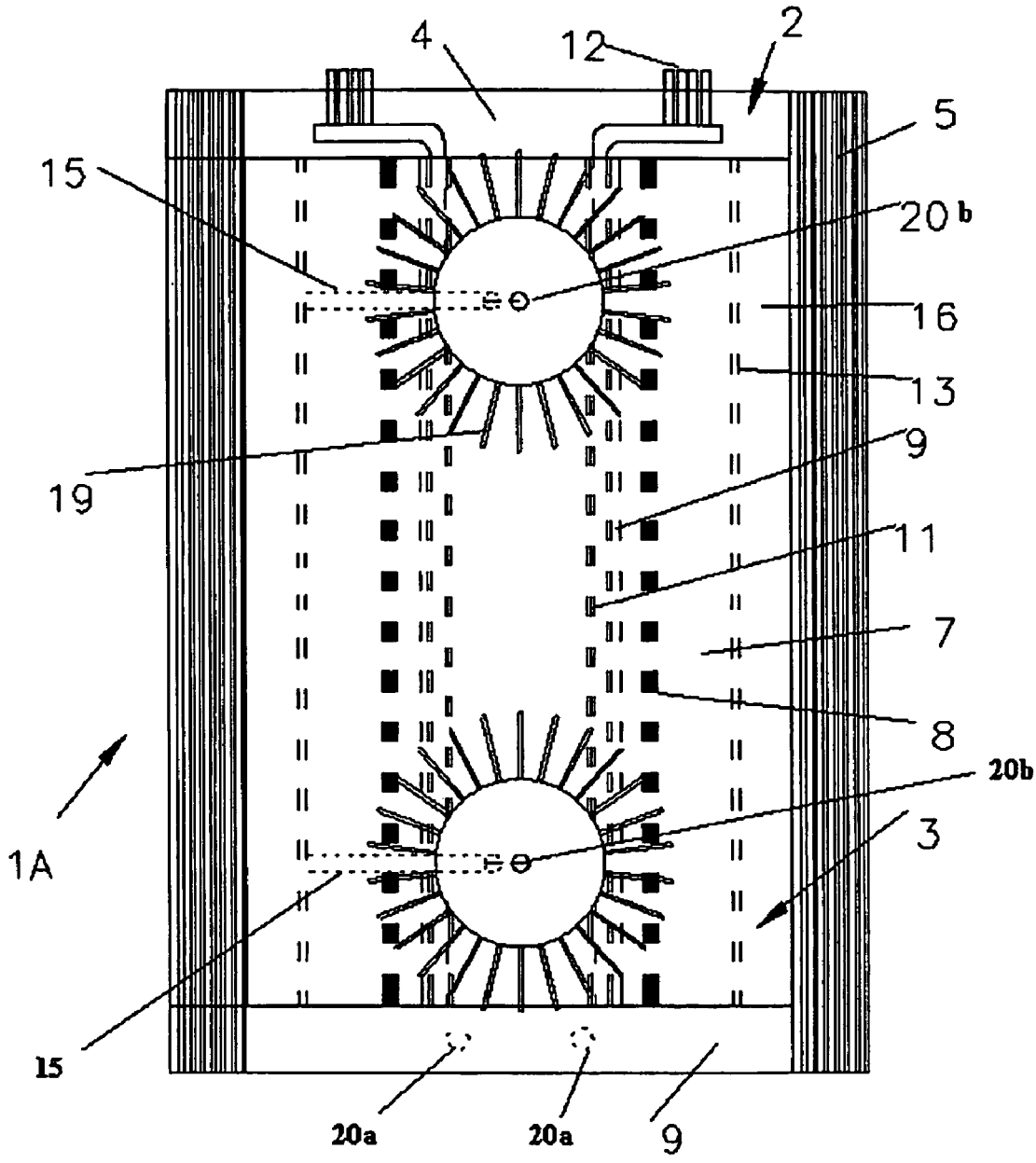
Figure 3:
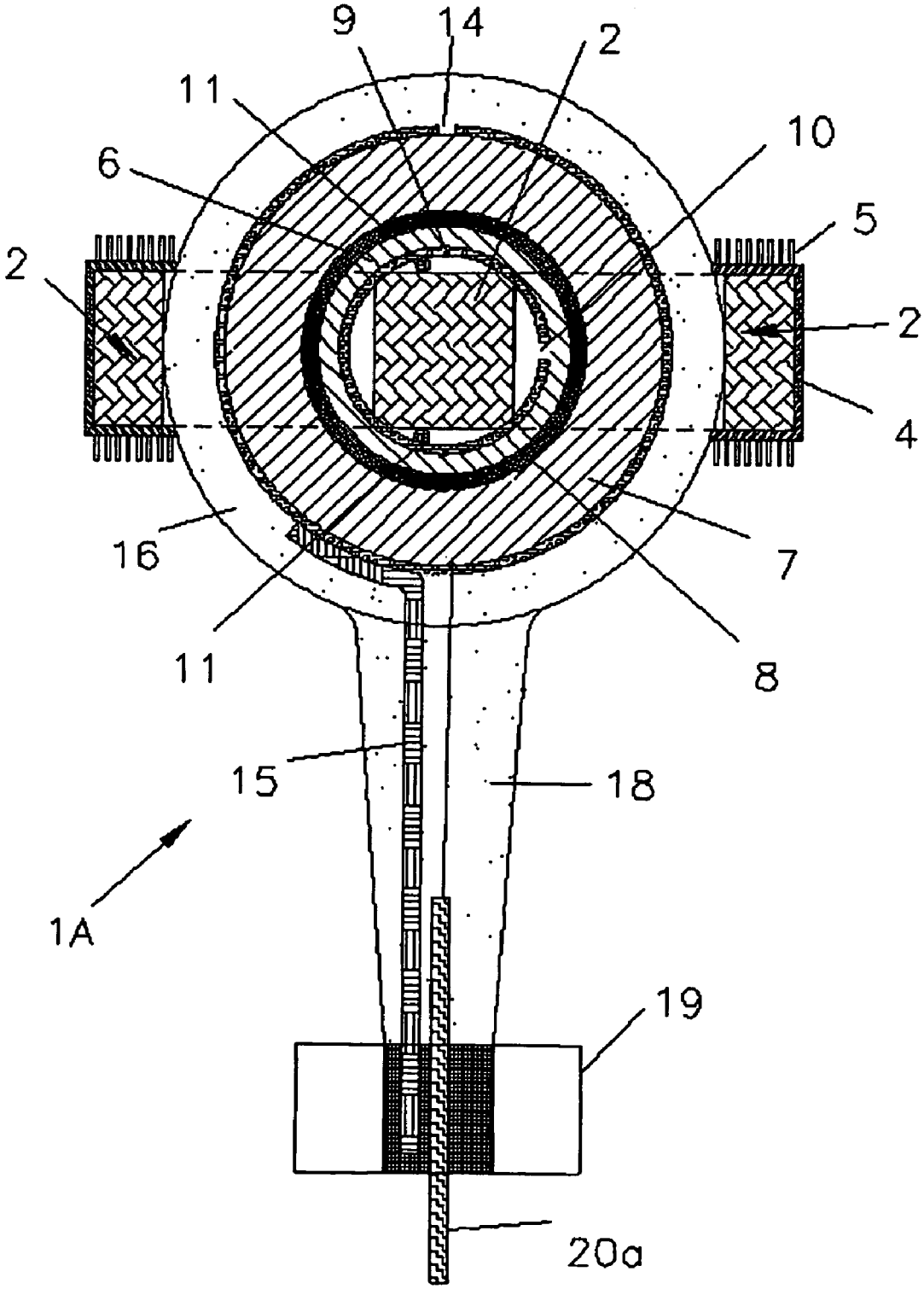
Figure 4:
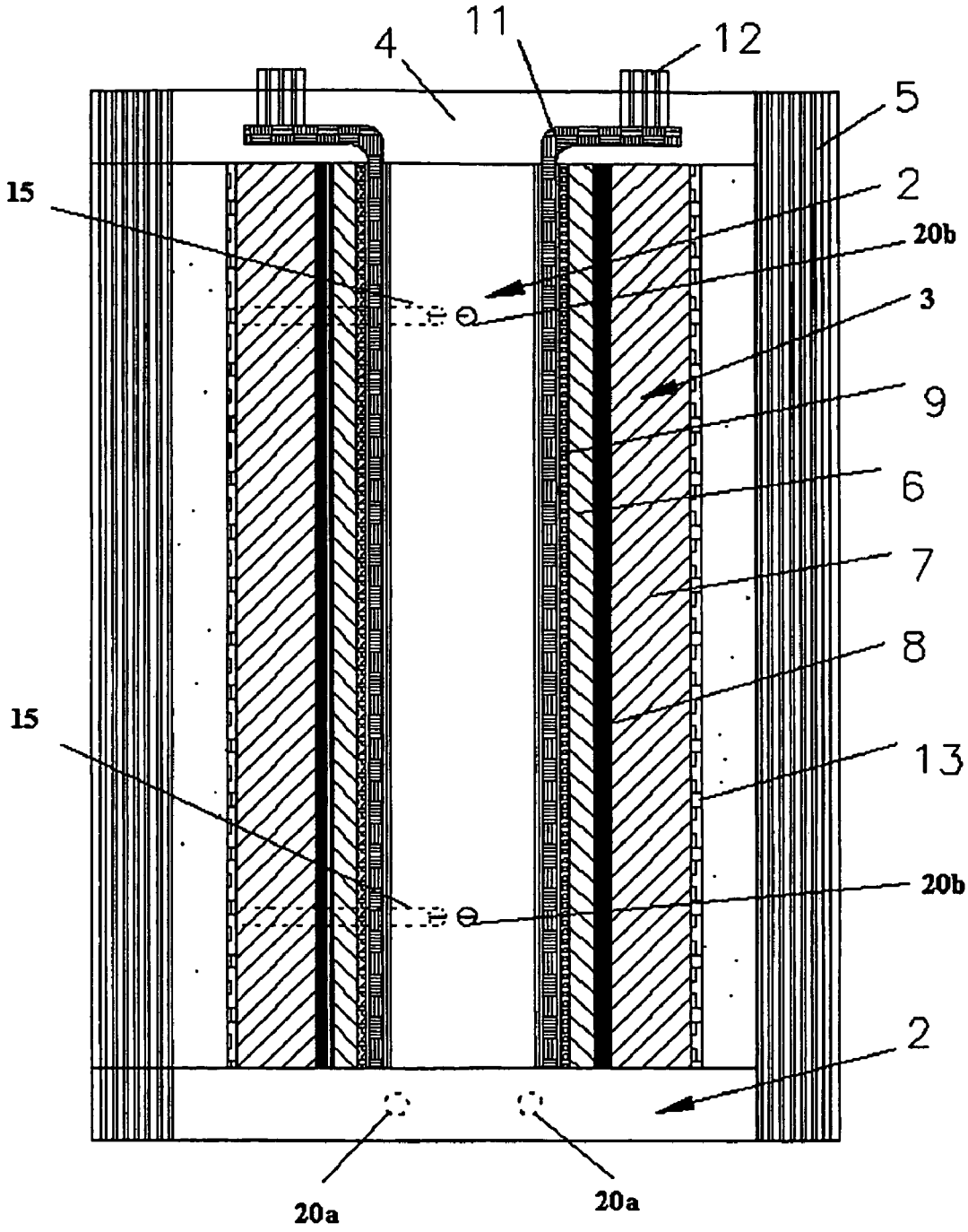
Figure 5:
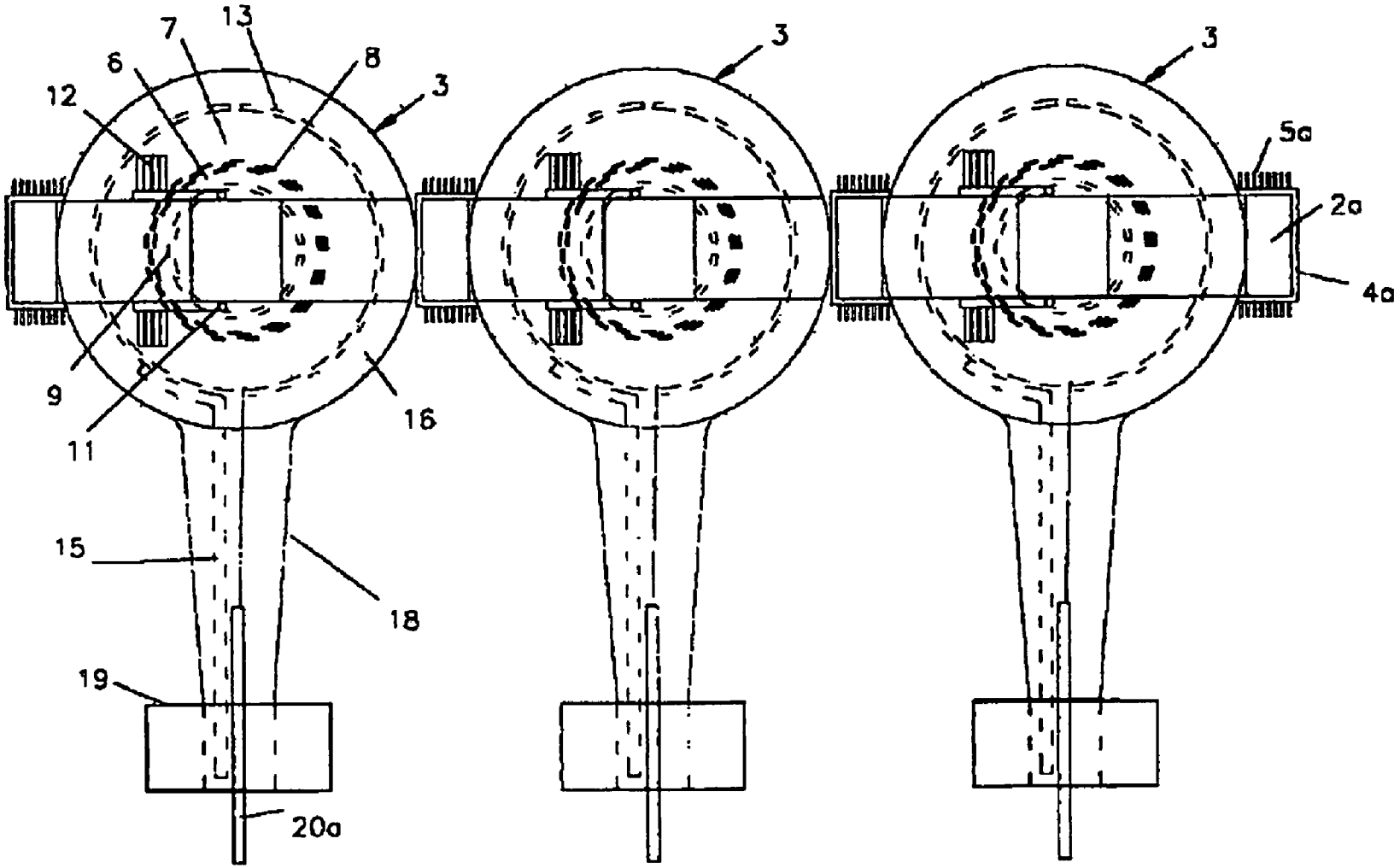
FIGS. 5, 6, 7 and 8 are plan, elevation, vertical cross-section and horizontal cross-section respectively of a three phase compact improved dry transformer according to another embodiment of the invention.
Figure 6:
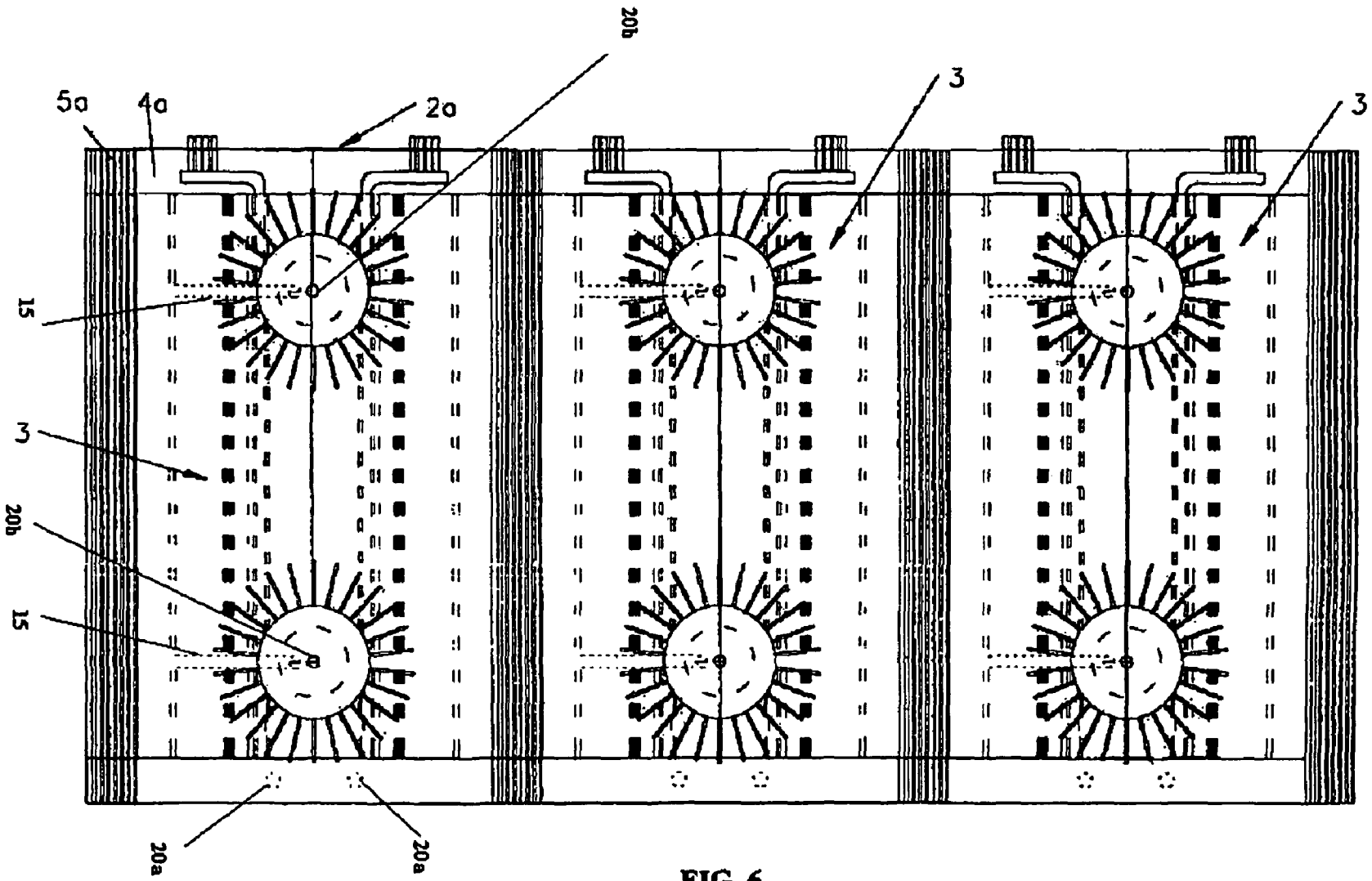
Figure 7:
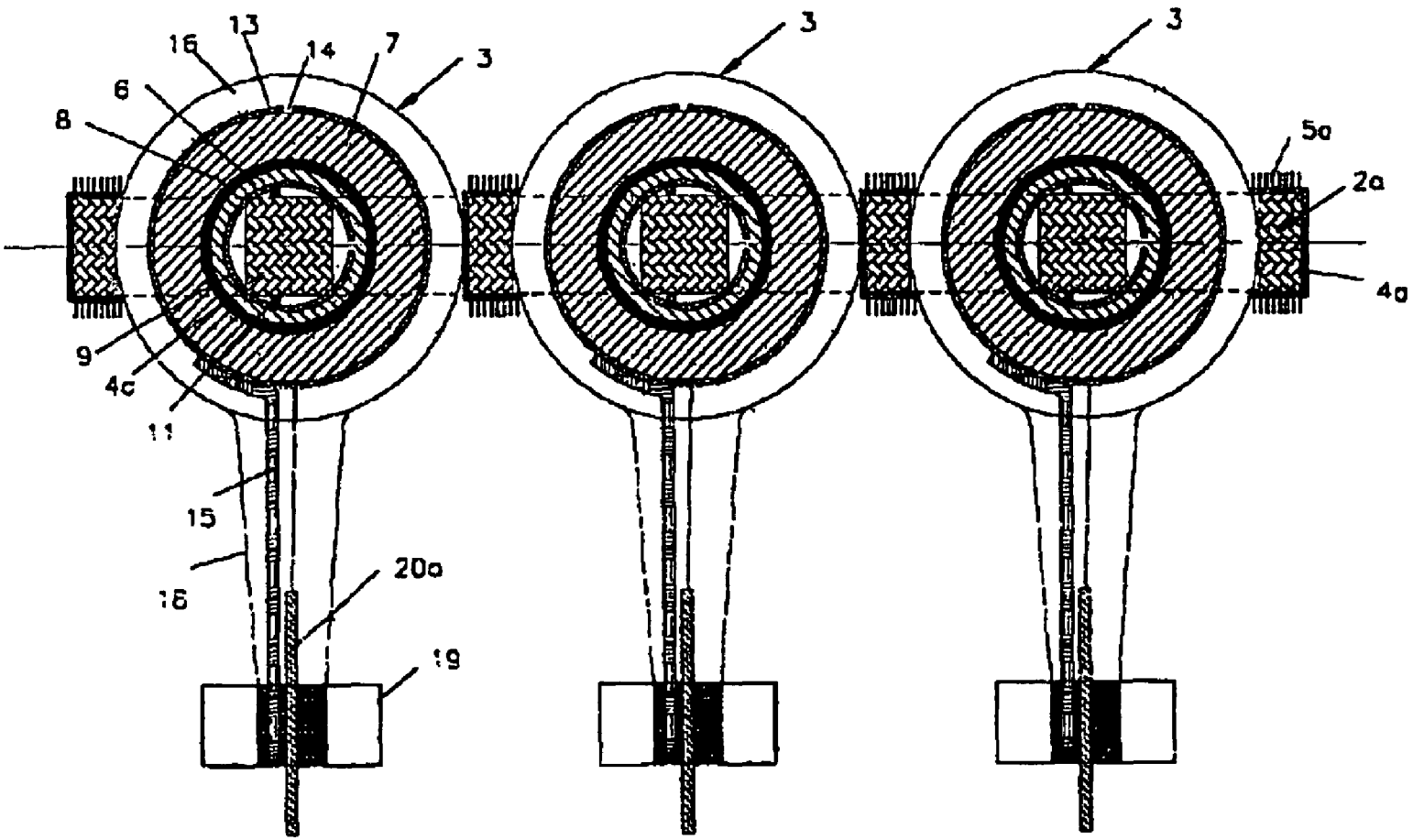
Figure 8:
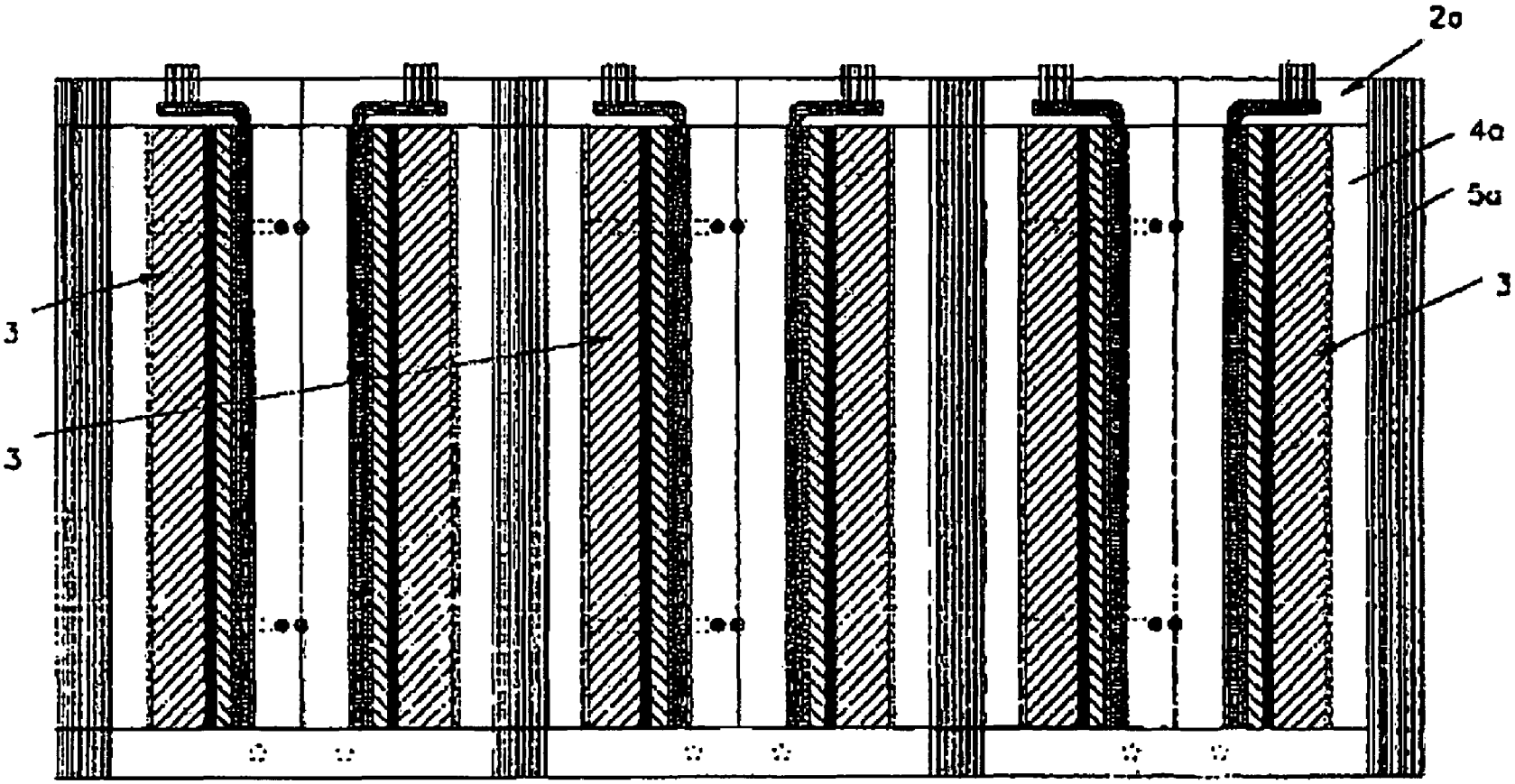

The single phase transformer 1A as illustrated in FIGS. 1 to 4 of the drawings accompanying the provisional specification comprises a magnetic material core 2 and a coil assembly 3 assembled onto the core. The core comprises heat dissipating covers 4 with cooling fins 5 snug fitted over the core. The coil assembly 3 comprises a low voltage winding 6 and a high voltage winding 7 with electric insulation layers 8 between the windings. The coil assembly also comprises electric insulation layers (not shown) between the layers of conductors of each of the windings. The coil assembly is mounted on the core over a heat dissipating inner jacket 9 in close contact therewith. The inner jacket is provided with a slit 10 along the length thereof. Two first heat pipes 11 are directly oppositely located between the core and inner jacket in close contact therewith. The first heat pipes protrude out of the coil assembly and are provided with cooling fins 12 at the protruding ends thereof. The coil assembly further comprises a heat dissipating outer jacket 13 snug fitted over the high voltage winding. The outer jacket is provided with a slit 14 along the length thereof. Two second heat pipes 15 are located against the outer jacket in close contact therewith. The coil assembly with the outer jacket is encapsulated with a resin casting marked 16 with the second heat pipes 15 protruding out of bushings 18 cast with the resin casting 16. The protruding outer ends of the second heat pipes are isolated from the ground potential by the bushings and are provided with cooling fins 19. 20*a* and 20*b* are terminals of the transformer located in the bushings and connected to the high voltage winding ends and low voltage winding ends, respectively. The three phase transformer 1B as illustrated in FIGS. 5 to 8 of the drawings accompanying the provisional specification comprises a core 2*a* and three coil assemblies 3 assembled onto the core as described earlier. The covers on the core and the fins on the covers are marked 4*a* and 5*a* respectively.

During operation of the transformer heat being generated in the core is conducted to the fins 5 and 5*a* by the respective covers and radiated away by the fins. Heat being generated in the core is also conducted to the fins 12 of the heat pipes 11 and radiated by the fins. Heat being generated in the windings is conducted to the inner and outer jackets and radiated away by the fins 12 and 19 via the respective heat pipes. As the inner and outer jackets are in touch with the low voltage winding and high voltage winding around the entire peripheries of the low voltage winding and high voltage winding heat transfer from the windings to the jackets all around and practically uniform. This ensures efficient heat removal from all around the windings. The slits in the inner and outer jackets ensure discontinuity to the flow of current through the jackets and prevent short circuit in the transformer. According to the invention, the resin impregnation or encapsulation of the coil assembly is eliminated. Heat sinks within the coil assembly between the windings is also eliminated. Therefore, resistance to the flow of heat being generated in the windings during working of the transformer is reduced considerably. The flow of heat in the windings to the inner and outer jackets is very fast and the heat dissipation to the surroundings by the jackets and the associated heat pipes is very fast. This improves the cooling efficiency of the transformer considerably. As the cooling efficiency of the transformer is considerably increased, retention of heat in the coil assembly is reduced and damage to the coil assembly is reduced thereby improving the life of the transformer. As the cooling efficiency is improved, cross-sections of the conductors of the windings are also reduced for given current densities thereby reducing the material cost of the conductors and the size and weight of the transformer and magnetic losses of the transformer. Because of the elimination of the heat sink between the windings, the size of the high voltage winding is also reduced correspondingly reducing the material cost of the high voltage winding and the size and weight of the transformer. Due to the elimination of the resin impregnation or encapsulation within the windings and the increase in the cooling efficiency of the transformer the layers of conductors of both the windings can be closer so as to further reduce the cost, size and weight of the transformer. At the same time, the resin encapsulation externally of the transformer helps to retain and maintain all the other desirable aspects and properties of the dry transformer like resistance to ultra-violet rays and moisture, flame proof nature, excellent insulation characteristics or the benefit of being operated at higher temperatures.

Comparative studies were carried out using a dry transformer of PCT Publication No WO 2006/016377 and an improved dry transformer of the invention. The transformers used were 25 KVA, 11 KV/250V and the results were as shown below:

TABLE 1

| Wt of copper conductors of the windings | | | |
|---|---|---|---|
| | High Voltage winding | Low Voltage winding | Core Wt |
| Transformer of PCT Publication | 48 kg | 24 kg | 136 kg |
| Transformer of invention | 33 kg | 16 kg | 96 kg |

Table 1 clearly shows that there is substantial savings in the material of the core and coil assembly of the transformer of the invention.

TABLE 2

| | Ambient | High Voltage winding (180 W) Rise in temperature | Low voltage winding (187 W) Rise in temperature |
|---|---|---|---|
| Transformer of PCT Publication | 50° C. | 73° C. | 69° C. |
| Transformer of invention | 50° C. | 65° C. | 65° C. |

The reduced rise in temperature in the windings of the transformer of the invention as seen in Table 2 is significant and consequential in the actual operating conditions of a transformer as reduction in the rise in temperature of even such magnitude improves the cooling efficiency and performance of the transformer.

The transformer can be two phase also and there can be more than two first and second heat pipes depending upon the rating of the transformer. The electric insulation layers are formed by electric grade plastic films. The covers and inner and outer jackets are made of materials having good thermal conductivity and are preferably made of aluminium. They have preferably thickness of 2 to 5 mm. Any known resin is used for encapsulation of the transformer. Preferably the resin is polycrete.

The invention claimed is:

1. An improved compact dry transformer comprising a magnetic material core and a coil assembly assembled onto the core, the core comprising heat dissipating covers with cooling fins snug fitted over the core, the covers being made of non-magnetic material having good thermal conductivity, the coil assembly comprising a low voltage winding and a high voltage winding with electric insulation layers between the layers of conductors of each of the windings and between the windings, the coil assembly being mounted on the core over a heat dissipating inner jacket made of non-magnetic material having good thermal conductivity in close contact with the inner jacket, the inner jacket having a slit along the length thereof, at least one first heat pipe located between the core and inner jacket in close contact therewith, the first heat pipe protruding out of the coil assembly and being provided with cooling fins at the protruding thereof, the coil assembly further comprising a heat dissipating outer jacket made of non-magnetic material having good thermal conductivity snug fitted over the high voltage winding, the outer jacket being provided with a slit along the length thereof, at least one second heat pipe located against the outer jacket in close contact therewith, the coil assembly with the outer jacket and second heat pipe being encapsulated with a resin casting with the second heat pipe protruding out of bushings cast with the resin casting, the protruding outer end of the second heat pipe being isolated from the ground potential by the bushings and provided with cooling fins, the terminals of the transformer being located in the bushings and connected to the windings ends.

* * * * *